US006522348B1

(12) United States Patent
Brot et al.

(10) Patent No.: US 6,522,348 B1
(45) Date of Patent: Feb. 18, 2003

(54) CARTRIDGE FOR CONSUMABLE PRODUCT FOR A PRINTER

(75) Inventors: Michel Brot, Argenteuil (FR); Alex Khun, Auvers sur Oise (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/674,166

(22) PCT Filed: Apr. 30, 1999

(86) PCT No.: PCT/FR99/01032

§ 371 (c)(1),
(2), (4) Date: Oct. 27, 2000

(87) PCT Pub. No.: WO99/56962

PCT Pub. Date: Nov. 11, 1999

(30) Foreign Application Priority Data

Apr. 30, 1998 (FR) ..... 98 05517

(51) Int. Cl.[7] ..... B41J 33/60

(52) U.S. Cl. ..... 347/214; 347/19; 400/70

(58) Field of Search ..... 347/214, 7, 19, 347/84, 85; 355/206; 399/12; 400/61, 70, 73

(56) References Cited

U.S. PATENT DOCUMENTS 4,961,088 A * 10/1990 Gilliland et al. ..... 355/206
5,137,379 A * 8/1992 Ukai et al. ..... 400/121
5,354,134 A * 10/1994 Patry ..... 400/73
5,688,056 A * 11/1997 Peyret ..... 400/61
6,144,812 A * 11/2000 Ueno ..... 399/12

* cited by examiner

*Primary Examiner*—Anh T. N. Vo
(74) *Attorney, Agent, or Firm*—Miles & Stockbridge P.C.

(57) ABSTRACT

A cartridge for consumable product for a printer includes an electronic chip for storing technical data characteristic of the consumable product and for controlling printing. The chip is arranged to be read by the printer, and the chip is disposed on a removable support card. The chip stores one or more parameters for controlling printer operation and is arranged for the downloading of technical data from a server.

29 Claims, 2 Drawing Sheets

CARTRIDGE FOR CONSUMABLE PRODUCT FOR A PRINTER

BACKGROUND OF THE INVENTION

1. Field of the Invention

The present invention relates to a cartridge for consumable product for a printer, such as printing powder or toner, for a laser printer or else ribbon for printing by thermal transfer of ink. The expression thermal transfer is understood to mean any process for transferring ink from a ribbon by means of a thermal source, and hence including the process of sublimation.

2. Description of the Related Art

In the case of a laser printer, the latter includes an electrostatic developing drum on which is formed, by an electrically charged roller, a layer of electric charges. Angularly downstream, the laser scans each generatrix which passes so as to form a latent image according to the data which control it. When the generatrices of the roller subsequently pass by a cartridge of pigment, or toner, the particles of the latter are attracted by the remaining charges and the latent image is thus revealed so that its particles of pigment are deposited gradually on a sheet travelling against a replenisher of the roller. A fuser subsequently causes the toner to penetrate into the paper so as to fix it therein definitively, aftersetting the thickness of pigment via an adjustable-potential blade.

The quality of the image depends on the collection of settings of the various voltages of the above elements and on the temperature of the fuser, as a function of the type of pigment, its make and the manufacturer of the printer.

Furthermore, this optimum collection of settings varies as a function of the percentage of pigment remaining in the cassette which contains it.

In practice, when a new cassette of pigment is installed, the printer automatically prints a test pattern and an optical sensor determines the quality of the result obtained, so as to determine empirically a substantially optimal collection of settings. However, the sensor provides only relatively poor information, given the number of setting parameters, so that the overall setting is only coarse and it offers no guarantee of long-term reliability.

In the case of the thermal-head printer, the thermal source of the printer, using ordinary paper and a thermal-transfer printing ribbon, comprises a write head including a plurality of heating elements controlled electrically by logic cues.

The printing quality depends directly on the thermalhead control characteristics including, in particular, the printing ribbon characteristics.

As characteristics of a thermal-transfer printing ribbon may be cited:

- its type: employing black ink, colour ink, monochrome or employing multiple regions of colour, through thermal transfer proper or through sublimation, metallized or the like,
- the region of colour at the instant of printing,
- the colour of the region,
- the level within the region at the instant of printing,
- the start of the relevant region,
- the level within the ribbon at the instant of printing,
- the definition of the colours of the regions of the ribbon.

There is therefore a great variety of possible ribbons.

U.S. Pat. No. 5,491,540 teaches a cartridge for consumable product for a printer which includes a data memory card, specifying the characteristics of the product, which can be linked by a connector to a controller of the printer.

With the aim of optimizing the printing quality of printers receiving a consumable product, the applicant has therefore had the idea of proposing the invention which will now be presented.

BRIEF SUMMARY OF THE INVENTION

To this end, the invention relates to a cartridge for consumable product for a printer, comprising an electronic chip for storing technical data characteristic of the consumable product and for controlling printing, the chip being arranged so as to be read, which cartridge is characterized in that the storage chip is disposed on a removable support card and is arranged for the downloading of the technical data.

In one interesting embodiment, with, as consumable product, toner, the storage chip (4) holds data for setting the voltage of at least one printing roller and the temperature of a fuser for fusing the toner.

The invention will be better understood with the aid of the following description of two preferred embodiments of the cartridge of the invention, with reference to the figures very diagrammatically representing in section an inking ribbon cartridge, and the printing part of a thermal-head printer, here belonging to a fax machine.

BRIEF DESCRIPTION OF THE SEVERAL VIEW OF THE DRAWINGS

DETAILED DESCRIPTION OF THE INVENTION

Figure 1:
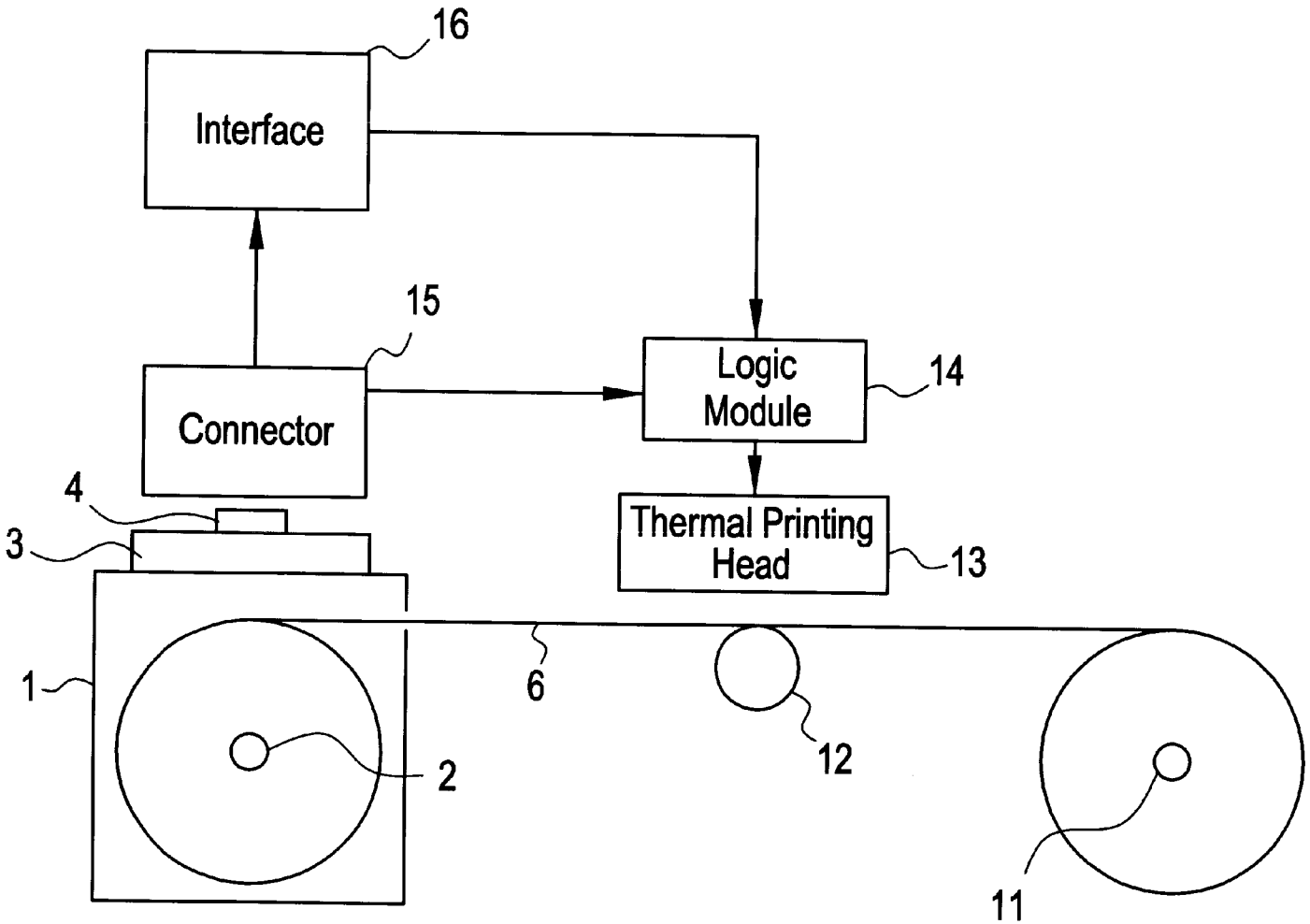
FIG. 1 shows a product in accordance with one embodiment of the invention.

The ribbon cartridge, reference 1, is represented mounted in a fax machine, as shown in FIG. 1. It includes a reel 2 carrying a roll of printing ribbon 6, which ribbon is received on a reception reel 11 after passing between a thermal printing head 13 and a counter-bracing roller 12, with a sheet of paper to be printed, not represented.

The cartridge 1 carries, on an accessible face, a circuit 3 for capturing technical data characteristic of the ribbon 6 and for controlling printing of the head 13. The circuit 3 is here a card carrying an electronic chip 4 which co-operates, via contact regions of the card 3, with a connector 15 of the printer linked to a logic module 14 for controlling the head 13. The chip card 3 can thus be read by this logic module 14 so that the latter captures, in the memory of the chip 4, the parameters or characteristics for controlling the head 13, such as the type of ink of the ribbon 6, which were eluded to at the start. The chip card 3 therefore stores the control data and offers access to their reading via the logic module 14.

The data-capture circuit 4 can be disposed on a-removable support card such as a chip card and, in this case, the user lays or inserts the capture chip-card (3,4), on or into a connector (15) which is then able to be integrated with the logic module 14.

Figure 2:
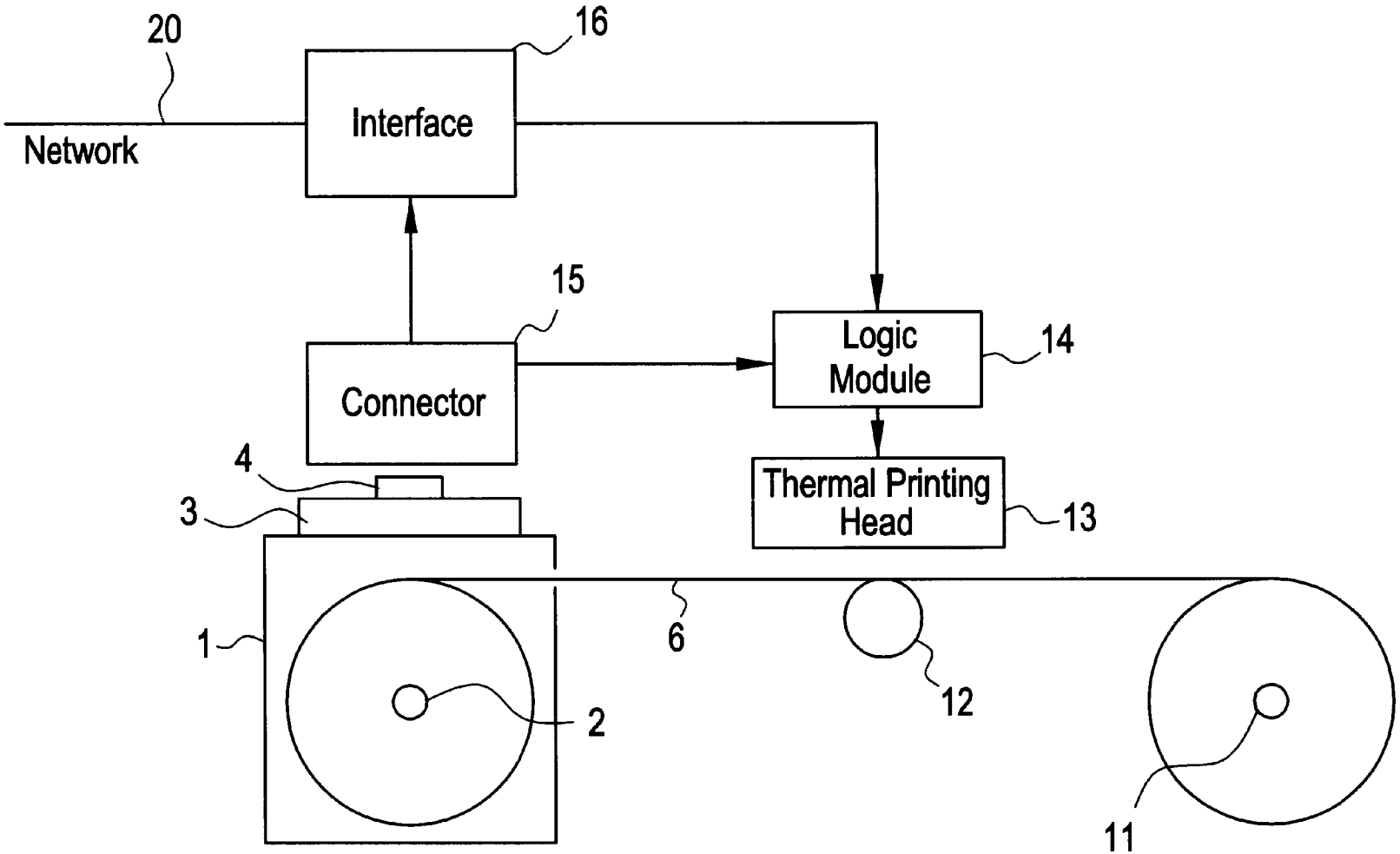
FIG. 2 shows a product in accordance with another embodiment of the invention.

As a variant cr as a supplement, provision may be made to capture all or some of the data for controlling the head 13 by downloading these data from a servers as illustrated, for example, in FIG. 2.

In this case, since the fax machine, which includes the printer, has an interface 16 for plugging into a data transmission network (20), such as the switched telephone network or the Internet, the chip 4 can control the interface 16, via the connector 15, so as to establish a link with the server, so as to download the logic module 14 via the control data appropriate to the ribbon on the cartridge 1. To do this, the chip 4 sends on-line the call number of the server and then, communication having been established, the chip transmits data to the server identifying the type of cartridge, such as a reference number. This number serves as an internal address within the server for selecting the appropriate data for controlling the head 13 and sends them back to the logic module 14, across the interface 16.

In the case of the second embodiment, relating to a laser-head printer, the chip card 3 is associated with a printing pigment (toner) cartridge. The control data of the chip card 3 then include various command sets for setting the voltages of various rollers or drums eluded to at the start and the temperature of the fuser, as a function of the pigment of the cassette. The influence of hygrometry can likewise be modelled and taken into account based on the readouts of a sensor. Preferably, the logic module 14 includes a microprocessor associated with a memory containing data identifying the type of printer. The logic module 14 thus selects the command set, of the chip card 3, which relates to the printer.

Furthermore, the chip card 3 includes, for each command set, several data blocks, or arrays, each representing the optimal set as a function of the degree of emptiness of the, pigment cassette, for example initially, after one thousand printouts and after two thousand printouts.

The logic module 14 counts the number of prints and thus updates the optimal set of parameters, possibly by interpolating between two successive sets.

The chip card 3 having from the outset provided the logic module 14 with the identity of the cassette and hence its capacity in terms of number of printouts, the logic module 14 commands the displaying of a corresponding warning message, on a fax machine screen, when the cassette is practically depleted.

Provision may also be made for it to be the chip 4 which, in addition to the storing in memory of the data for intelligent management of the settings, performs the tasks, set out above, of the logic module 14. Hence, the intelligence is then almost totally in the chip card 3, as far as the settings are concerned, the logic module 14 merely retransmitting the settings to the slaved elements and providing the chip card 3 with the information. This kind of intelligent control based on the chip card 3 is also valid for any other consumable product, so as to ensure improved, optimal, management of the printer.

What is claimed is:

1. A cartridge for holding a printing medium for a-printer, comprising:

an electronic chip for storing technical data for operating the printer with the printing medium, wherein said chip is disposed on a removable support card and stores information for downloading said technical data from a server.

2. A cartridge according to claim 1, wherein the printing medium is toner, and wherein said technical data corresponds to a voltage of at least one printing roller in the printer.

3. A cartridge according to claim 1, wherein said technical data corresponds to a temperature of a fuser in the printer for fusing toner.

4. A cartridge according to claim 1, wherein said technical data is associated with various degrees of toner-filling of the cartridge.

5. A product, comprising:

a housing containing a printing medium;

a circuit card removably mounted to said housing; and a chip, carried on said circuit card and electrically connected thereto, for storing information for controlling a printing device, said chip having stored therein data for downloading said information from a server.

6. A product according to claim 5, wherein said printing medium is one of toner and an ink ribbon.

7. A product according to claim 5, wherein said printing device is a laser printer, and wherein said information models an influence of hygrometry based on readouts of a sensor.

8. A product according to claim 5, wherein said chip stores information for establishing a connection to a server along a communications network.

9. A product according to claim 5, wherein said printing device is a laser printer.

10. A product according to claim 9, wherein said information is indicative of at least one of a voltage for a printing roller or drum and a temperature of a fuser of said laser printer.

11. A product according to claim 9, wherein said printing medium is toner and wherein said information corresponds to said voltage or temperature as a function of a type of said toner in said housing.

12. A product according to claim 9, wherein said printing medium is toner and wherein said information corresponds to said voltage or temperature as a function of an amount of toner in said housing.

13. A product according to claim 9, wherein said information includes a plurality of command sets, each of said command sets designating a different control setting of said laser printer.

14. A product according to claim 13, wherein each of said command sets includes parameter settings for said laser printer, each of said parameter settings corresponding to a different state of emptiness of toner in said housing.

15. A product according to claim 14, wherein said chip outputs information indicating a state of emptiness of toner in said housing.

16. A product according to claim 13, wherein each of said command sets includes parameter settings for said laser printer, each of said parameter settings controlling said laser printer based on a predetermined number of printouts.

17. A product according to claim 16, wherein said chip includes a counter which counts a number of printouts from said laser printer.

18. A product according to claim 17, wherein said chip includes:

a comparing unit which compares the number of printouts counted by said counter to at least one of predetermined number of printouts, said chip outputting information corresponding to one of said parameter settings which most closely relates to the number of printouts counted by said counter.

19. A product according to claim 16, wherein said chip includes a unit which interpolates between two of said parameter settings when the number stored in the counter falls between two of said predetermined numbers of printouts.

20. A product according to claim 9, wherein said information includes a plurality of command sets, each of said command sets including control information for a different type of printer.

21. A product according to claim 5, wherein said printing device is a thermal-head printer, and wherein said information is for controlling said thermal-print head.

22. A product according to claim 21, wherein said information identifies a type of ink included on an ink ribbon included in said housing.

23. A product, comprising:

a housing containing a printing medium;

a circuit card removably mounted to said housing; and a chip carried on and electrically connected to said circuit card, said chip storing information for establishing a connection to a server along a communications network, wherein said chip stores additional information for instructing said server to download data for controlling a printing device into which said housing is installed.

24. A method for making a product for a printing device, comprising:

providing a housing which contains a printing medium; and providing a circuit card removably mountable to said housing, said circuit card including a chip for storing information for controlling said printing device, said chip having stored therein data for downloading said information.

25. The method of claim 24, further comprising:

removably mounting said circuit card to said housing.

26. A method for making a product for a printing device, comprising:

providing a housing containing a printing medium; and providing a chip removably mountable to said housing, said chip storing information for downloading a control parameter for said printing device through a network.

27. The method of claim 26, further comprising:

removably mounting said chip to said housing.

28. A method for making a product for a printing device, comprising:

mounting a chip on a housing containing a printing medium, said chip storing information for establishing a connection to a server along a network and additional information for instructing said server to download data for controlling the printing device.

29. A printer comprising a product as recited in claim 23.

* * * * *